US008752540B2

(12) United States Patent
Yen

(10) Patent No.: US 8,752,540 B2
(45) Date of Patent: Jun. 17, 2014

(54) WARMING OVEN HAVING LIGHT REFLECTION EFFECT

(75) Inventor: Wen Chang Yen, Kaohsiung (TW)

(73) Assignee: Allgreen Designs Co., Ltd., Kaohsiung (TW)

( * ) Notice: Subject to any disclaimer, the term of this patent is extended or adjusted under 35 U.S.C. 154(b) by 267 days.

(21) Appl. No.: 13/468,404

(22) Filed: May 10, 2012

(65) Prior Publication Data

US 2013/0160759 A1 Jun. 27, 2013

(30) Foreign Application Priority Data

Dec. 21, 2011 (TW) ..... 100224155 U

(51) Int. Cl.

| | |
|---|---|
| ***F24H 3/00*** | (2006.01) |
| ***F24C 15/22*** | (2006.01) |
| ***F24C 3/14*** | (2006.01) |
| ***F23C 3/00*** | (2006.01) |
| ***F24C 15/06*** | (2006.01) |
| ***F24C 15/00*** | (2006.01) |
| ***F24C 15/08*** | (2006.01) |
| ***F24C 3/00*** | (2006.01) |
| *F23D 14/12* | (2006.01) |

(52) U.S. Cl.

CPC . *F24C 15/22* (2013.01); *F24C 3/14* (2013.01); *F23C 3/002* (2013.01); *F24C 15/06* (2013.01); *F24C 15/007* (2013.01); *F24C 15/08* (2013.01); *F24C 3/002* (2013.01); *F23D 14/12* (2013.01); *F23D 2213/00* (2013.01); *F23D 2212/00* (2013.01)

USPC ..... 126/91 A; 126/92 B; 126/92 AC; 126/89

(58) Field of Classification Search

CPC ..... F24C 15/22; F24C 3/14; F24C 15/06; F24C 15/007; F24C 15/08; F24C 15/12; F24C 3/002; F24C 3/004; F23C 3/002; F23D 14/12; F23D 2213/00; F23D 2212/00

USPC ..... 126/91 A, 89, 92 B, 92 AC, 92 R

See application file for complete search history.

(56) References Cited

U.S. PATENT DOCUMENTS

2010/0236544 A1 * 9/2010 Hall et al. ..... 126/85 R

* cited by examiner

*Primary Examiner* — Alfred Basichas
(74) *Attorney, Agent, or Firm* — Kirschstein et al.

(57) ABSTRACT

A warming oven includes a base, a heating unit, a heat conducting unit, and a reflective shield. The base has an accommodating space. The heating unit is disposed within the accommodating space. The heat conducting unit includes a positioning plate, a top plate spaced apart from the positioning plate, a quartz glass tube inserted into the positioning plate and the top plate, and a plurality of upright connecting rods disposed around the positioning plate and the top plate. The reflective shield is formed with a plurality of vent holes, and includes a bottom cover that covers a top end of the heat conducting unit and that has a vertically curved outer mirror surface for reflecting light from a fire flame produced by the heating unit, thereby providing an illumination effect.

8 Claims, 6 Drawing Sheets

WARMING OVEN HAVING LIGHT REFLECTION EFFECT

CROSS-REFERENCE TO RELATED APPLICATION

This application claims priority of Taiwanese Application No. 100224155, filed on Dec. 21, 2011.

BACKGROUND OF THE INVENTION

1. Field of the Invention

This invention relates to a heating device, and more particularly to a heating device having light reflection effect.

2. Description of the Related Art

Referring to FIG. 1, a conventional outdoor warming oven 1 disclosed in Taiwanese Utility Model Patent Publication No. 392837 includes a barrel receiving cylinder 11 for accommodating a gas barrel (not shown) therein, a combustion unit 12 disposed fixedly above the barrel receiving cylinder 11, and a top cap 13 for covering the combustion unit 12. The combustion unit 12 includes a supporting post 121 fixed on and above the barrel receiving cylinder 11, an ignition switch 122 disposed on the supporting post 121, a burner 123 controlled by the ignition switch 122 to produce a fire flame, and a shield 123 surrounding the burner 123. The top cap 13 is disposed for covering the burner 124.

A fire produced by the burner 123 is used for heating air to form hot air. The top cap 13 can block the hot air from flowing into the atmosphere. Hence, surrounding air can be heated to increase the surrounding temperature. However, due to the presence of the top cap 13, the illumination effect is limited.

SUMMARY OF THE INVENTION

The object of this invention is to provide a warming oven that includes means for reflecting light for enhancing the illumination effect.

Accordingly, a warming oven of this invention includes a base, a heating unit, a heat conducting unit, and a reflective shield. The base has an accommodating space. The heating unit is disposed within the accommodating space. The heat conducting unit includes a positioning plate, a top plate spaced apart from the positioning plate, a quartz glass tube inserted into the positioning plate and the top plate, and a plurality of upright connecting rods disposed around the positioning plate and the top plate. The reflective shield is formed with a plurality of vent holes, and includes a bottom cover that covers a top end of the heat conducting unit and that has a vertically curved outer mirror surface for reflecting light from a fire flame produced by the heating unit, thereby providing an illumination effect.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
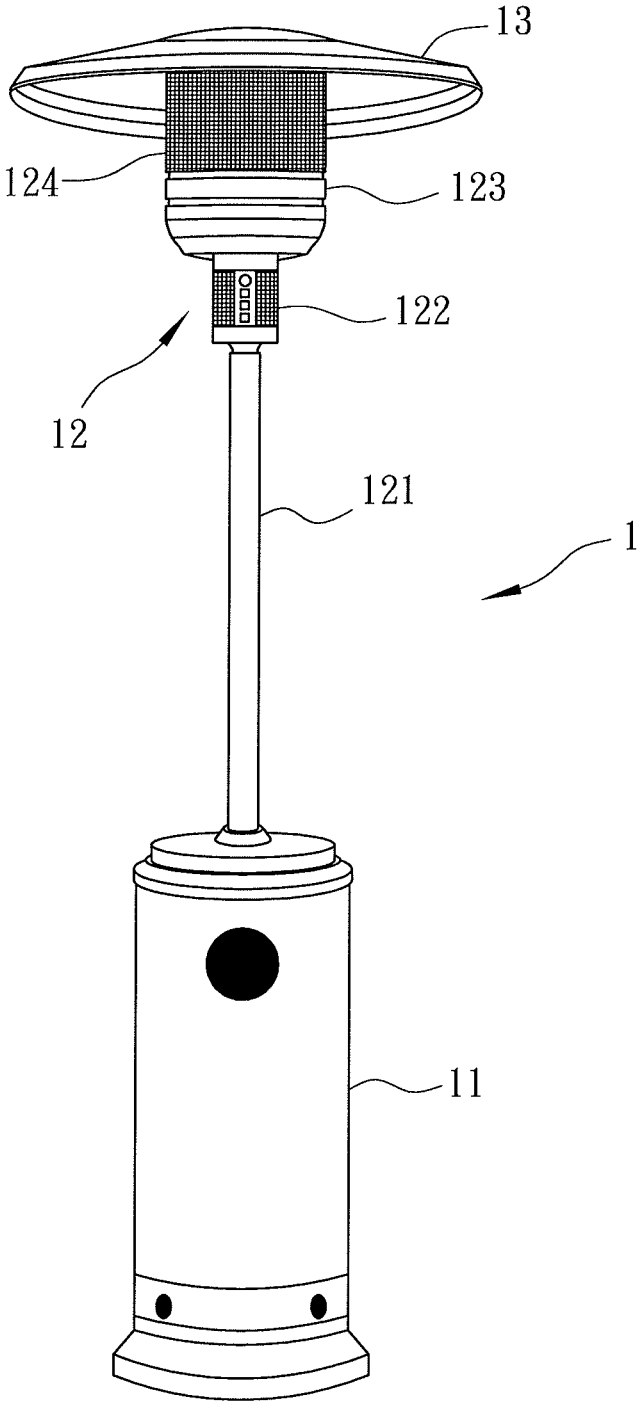
FIG. 1 PRIOR ART
FIG. 1 is a perspective view of a conventional warming oven disclosed in Taiwanese Utility Model Patent Publication No. 392837.
Figure 2:
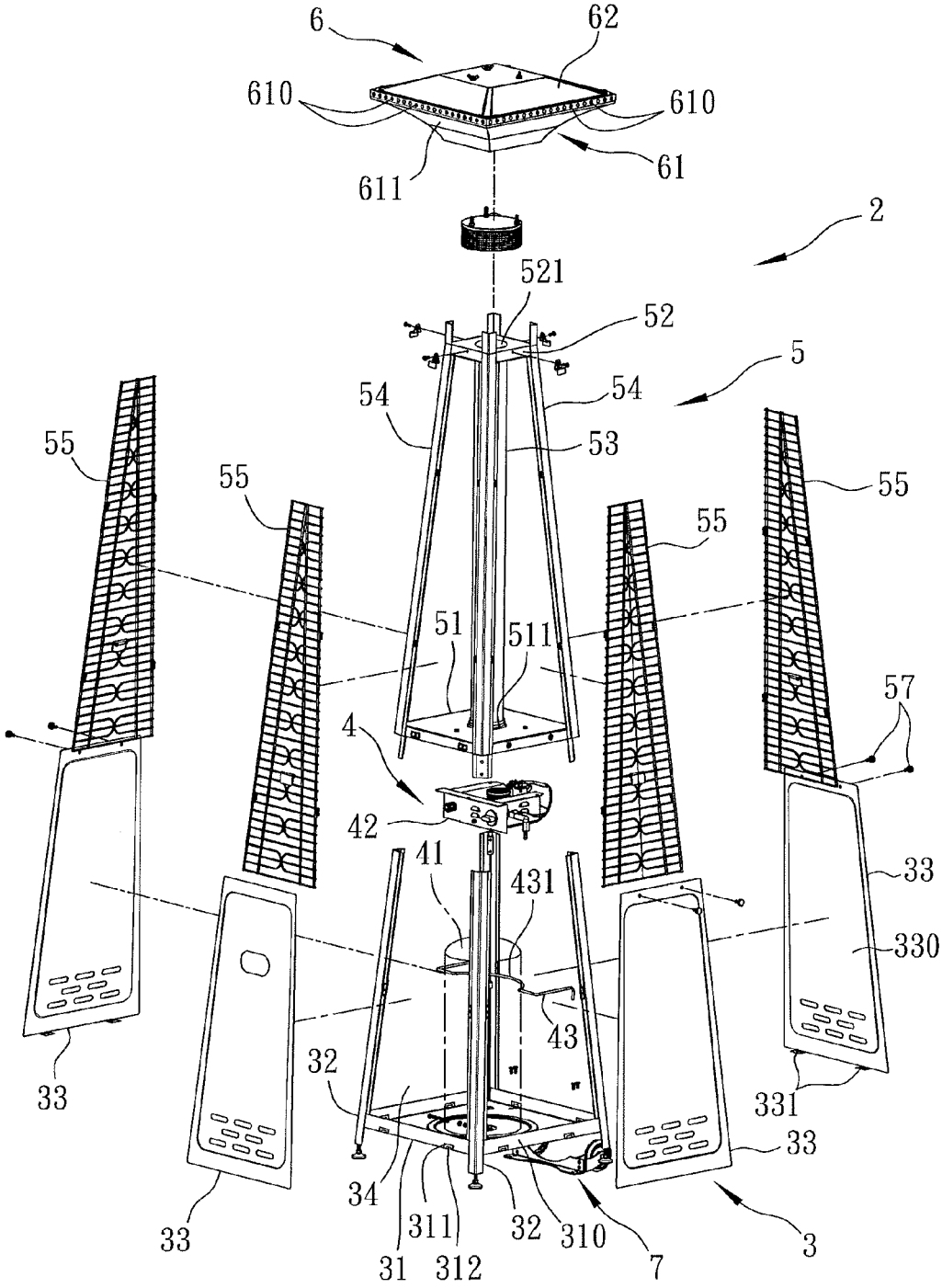
FIG. 2 is an exploded perspective view of the preferred embodiment of a warming oven according to this invention.
Figure 3:
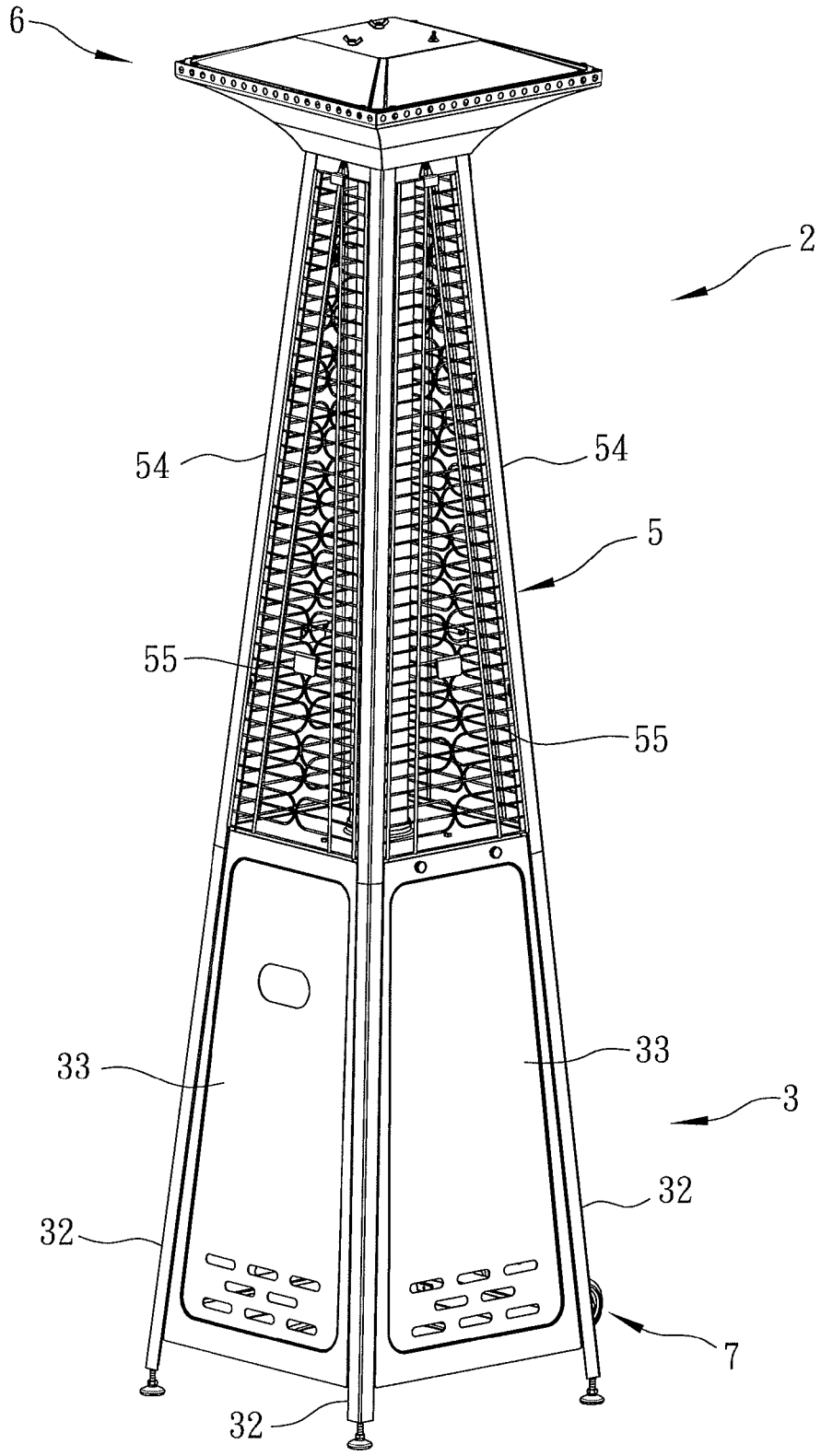
FIG. 3 is an assembled perspective view of the preferred embodiment.

Referring to FIGS. 2 and 3, the preferred embodiment of a warming oven 2 according to this invention includes a base 3, a heating unit 4, a heat conducting unit 5, a reflective shield 6, and a roller unit 7 disposed on a periphery of the base 3.

The base 3 includes a supporting plate 31, a plurality of upright supporting rods 32 disposed around and connected to the supporting plate 31, and a plurality of stop plates 33 each connected between two adjacent ones of the supporting rods 32. The supporting plate 31 cooperates with the supporting rods 32 and the stop plates 33 to define an accommodating space 34 above the supporting plate 31 and among the supporting rods 32 and the stop plates 33. In this embodiment, the supporting plate 31 is square, and has four upright side plate portions 310 disposed respectively at four sides thereof. Each of the sideplate portions 310 is formed with an inverted U-shaped slot 311 therethrough that has a horizontal slot section and two upright slot sections extending respectively and downwardly from two ends of the horizontal slot section to define a projecting plate portion 312 among the horizontal slot section and the upright slot sections. Each of the stop plates 33 has a plate body 330 and two retaining rings 331 welded to the plate body 330. Since each of the retaining rings 331 is sleeved on the corresponding plate portion 312, and since each of the lateral side surfaces of each of the stop plates 33 is in intimate contact with the corresponding supporting rod 32, the stop plates 33 can be positioned relative to the supporting plate 31 and the supporting rods 32.

The heating unit 4 is disposed within the accommodating space 34 in the base 3, and includes a fuel source 41 placed on the supporting plate 31, a heater 42 connected to the fuel source 41, and a position-limiting member 43 hooked removably on two adjacent ones of the supporting rods 32 for positioning the fuel source 41 within the accommodating space 34. The position-limiting member 43 and the roller unit 7 are adjacent to and located respectively to two opposite sides of one of the upright side plate portions 310 of the supporting plate 31. In this embodiment, the position-limiting member 43 has a curved rod portion 431 concave away from the fuel source 41 and toward the roller unit 7.

The heat conducting unit 5 is disposed on and above the base 3, and includes a positioning plate 51 formed with a first aperture 511, a top plate 52 disposed above and spaced apart from the positioning plate 51 and formed with a second aperture 521, an upright quartz glass tube 53 inserted into the first and second apertures 511, 521, a plurality of upright connecting rods 54 disposed around and connected fixedly to the positioning plate 51 and the top plate 52, and a plurality of net plates 55 surrounding the quartz glass tube 53. Each of the net plates 55 is connected fixedly between two adjacent ones of the connecting rods 54. The first aperture 511 in the positioning plate 51 is in fluid communication with the accommodating space 34.

Figure 4:
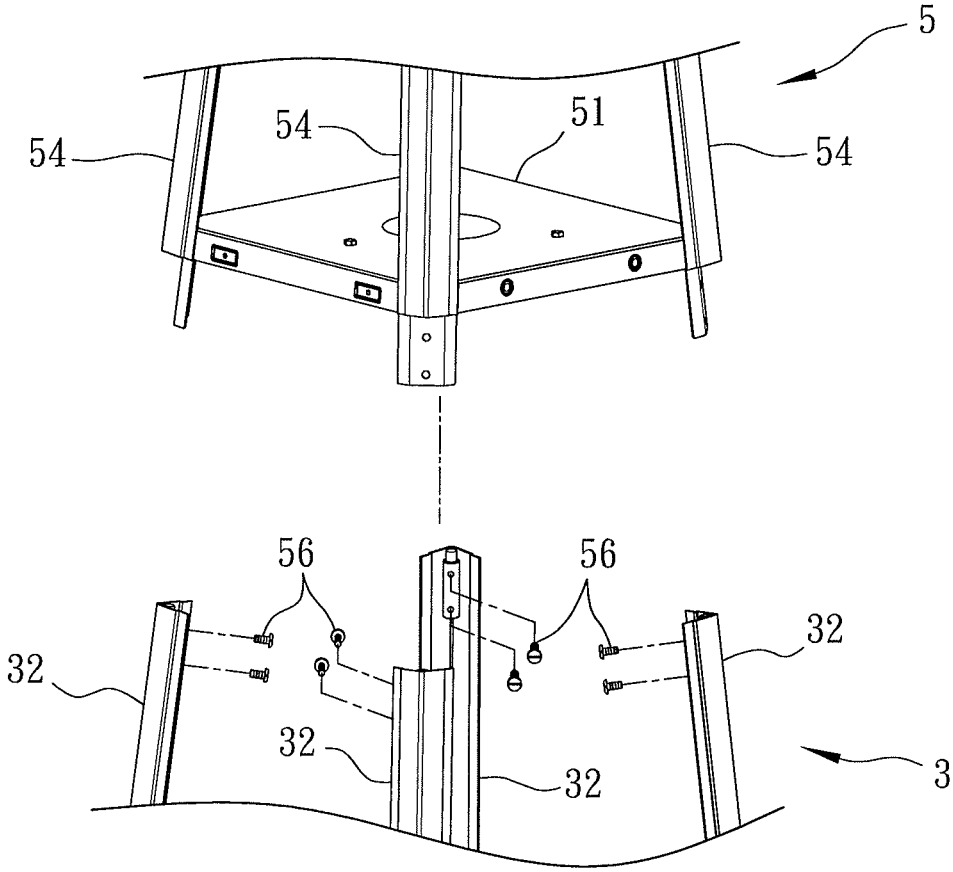
FIG. 4 is a fragmentary exploded perspective view of the preferred embodiment, illustrating how a heat conducting unit is connected to a base.

With further reference to FIG. 4, in this embodiment, the connecting rods 54 are connected respectively and removably to and disposed above the supporting rods 32 of the base 3 by first lock bolts 56, and top ends of the stop plates 33 of the base 3 are connected removably to the positioning plate 51 by second lock bolts 57 (see FIG. 2).

Figure 5:
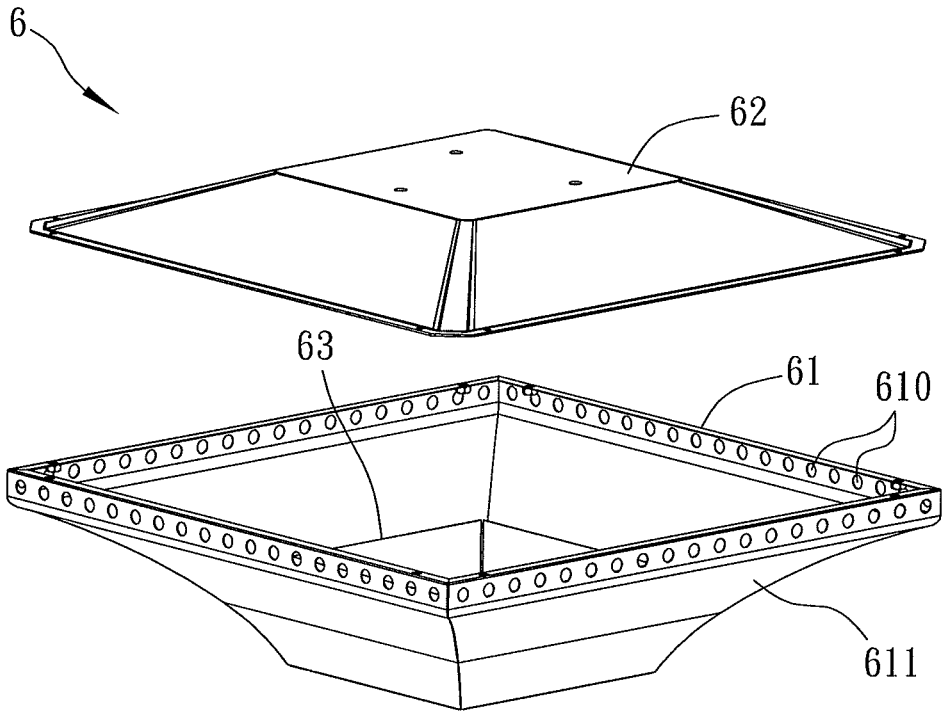
FIG. 5 is an exploded perspective view of a reflective shield of the preferred embodiment.

With further reference to FIG. 5, the reflective shield 6 includes a bottom cover 61 covering the second aperture 521 of the heat conducting unit 5 and formed with a plurality of vent holes 610, a top cover 62 covering and disposed above the bottom cover 61, and a fireproof frame 63 disposed fixedly on an inner surface of the bottom cover 61. The bottom cover 61 has a loop-shaped outer mirror surface 611 that extends upwardly and outwardly from a bottom end thereof and that is vertically curved. In this embodiment, the bottom cover 61 is made of stainless steel, and is formed with the outer mirror surface 611 by polishing.

Figure 6:
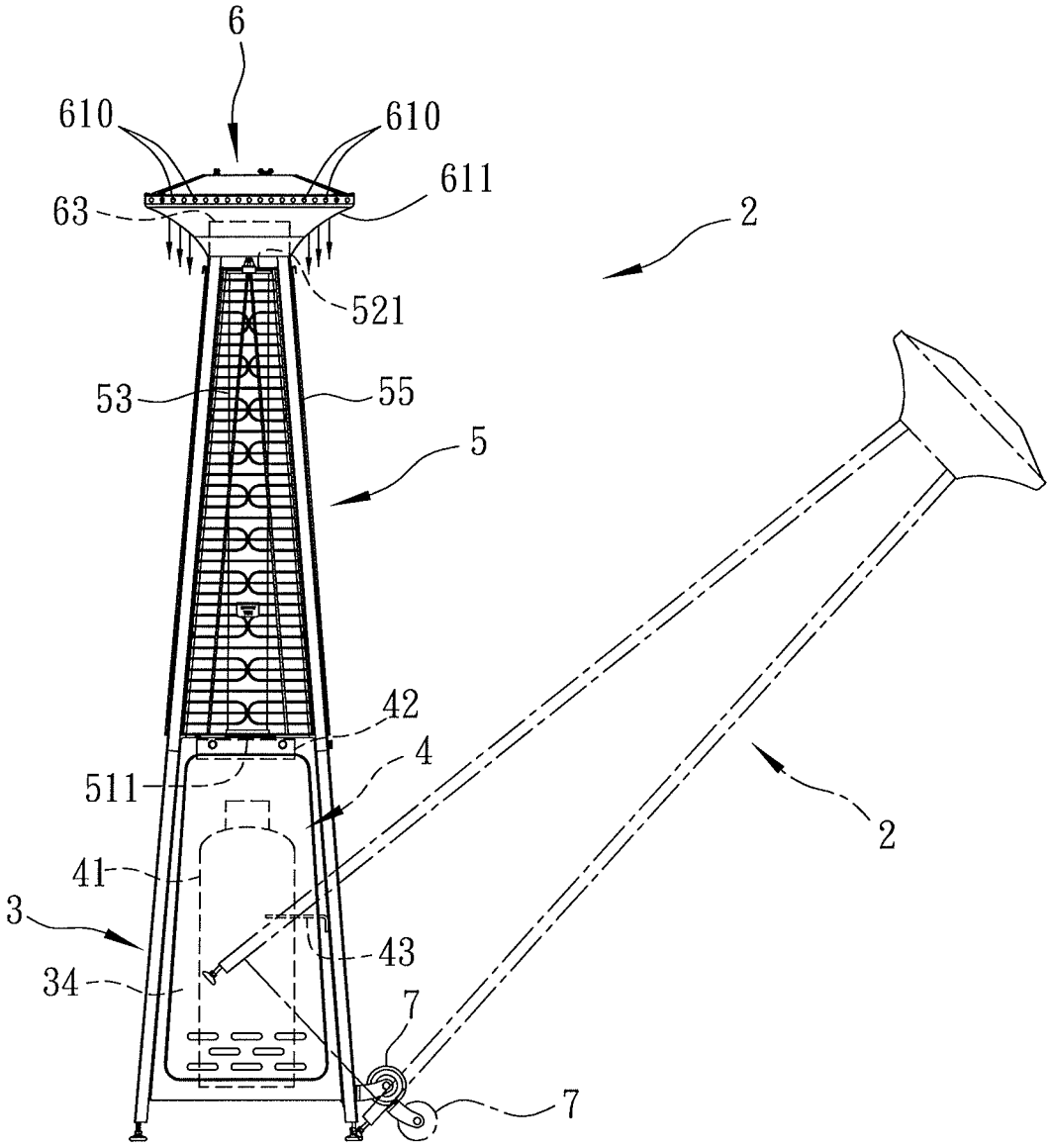
FIG. 6 is a schematic side view of the preferred embodiment, illustrating how the warming oven is converted into a wheeled device.

With further reference to FIG. 6, through operation of the heater 42, a fire flame is produced from the fuel source 41, and goes through the first aperture 511, the quartz glass tube 53, and the second aperture 521 of the heat conducting unit 5 to heat air in the quartz glass tube 53 to form hot air. The hot air flows out of the reflective shield 6 through the vent holes 610. At the same time, the quartz glass tube 53 is heated by the fire flame to increase the surrounding temperature. It should be noted that, when the fire flame goes upwardly out of the second aperture 521 in the heat conducting unit 5, it is surrounded by the fireproof frame 63 so as not to exit the reflective shield 6 through the vent holes 610. During occurrence of the fire flame in the quartz glass tube 53, the net plates 55 of the heat conducting unit 5 can prevent the user from scald.

Also during occurrence of the fire flame in the quartz glass tube 53, since the area of the reflective shield 6 is greater than that of the top plate 52, and since the reflective shield 6 is disposed directly above the top plate 52, when light is emitted upwardly from the fire flame, it can be reflected by the outer mirror surface 611 of the bottom cover 61 of the reflective shield 6. At this time, since the outer mirror surface 611 is vertically curved, the illuminated area, the illumination intensity, and the decorating effect can be increased. The outer mirror surface 611 is but not limited to square in cross-section.

In this embodiment, when it is desired to move the warming oven 2 by a short distance, the warming oven 2 is reclined from a vertical position shown by the solid lines in FIG. 6 to an inclined position shown by the phantom lines in FIG. 6 to allow the roller unit 7 to contact the ground surface. At this time, the warming oven 2 acts as a wheeled device, and is convenient to push. During movement of the warming oven 2, since the curved rod portion 431 of the position-limiting member 43 is concave toward the roller unit 7, the fuel source 41 can be supported stably by the position-limiting member 43. When it is desired to move the warming oven 2 by a long distance, the heat conducting unit 5 is first removed from the base 2. Next, the reflective shield 6 is removed from the heat conducting unit 5, and the fuel source 41 is removed from the base 3. Thereafter, the heat conducting unit 5 is inverted and inserted into the accommodating space 34 in the base 3. In this manner, the total height of the warming oven 2 can be reduced significantly, thereby resulting inconvenience during transportation.

To summarize, due to inclusion of the outer mirror surface 611 in the bottom cover 61 of the reflective shield 6, the illumination effect can be improved. Thus, the object of this invention is achieved.

With this invention thus explained, it is apparent that numerous modifications and variations can be made without departing from the scope and spirit of this invention. It is therefore intended that this invention be limited only as indicated by the appended claims.

I claim:

1. A warming oven comprising:

a base including a supporting plate and a plurality of upright supporting rods disposed around and connected to said supporting plate, said supporting plate cooperating with said supporting rods to define an accommodating space;

a heat conducting unit disposed above said base and including a positioning plate formed with a first aperture, a top plate disposed above and spaced apart from said positioning plate and formed with a second aperture, an upright quartz glass tube inserted into said first and second apertures, and a plurality of upright connecting rods disposed around said positioning plate and said top plate, said connecting rods being connected respectively to and disposed above said supporting rods, said first aperture in said positioning plate being in fluid communication with said accommodating space in said base;

a heating unit disposed within said accommodating space in said base for producing a fire flame such that said fire flame goes through said first aperture, said quartz glass tube, and said second aperture of said heat conducting unit; and a reflective shield formed with a plurality of vent holes and including a bottom cover that covers said second aperture in said top plate, said bottom cover having a bottom end and a loop-shaped outer mirror surface extending upwardly and outwardly from said bottom end for reflecting light from said fire flame.

2. The warming oven as claimed in claim 1, wherein said supporting rods of said base are connected respectively and removably to said connecting rods of said heat conducting unit.

3. The warming oven as claimed in claim 2, wherein said reflective shield further includes a top cover covering and being disposed above said bottom cover, and a fireproof frame disposed fixedly on an inner surface of said bottom cover.

4. The warming oven as claimed in claim 2, wherein said heat conducting unit further includes a plurality of net plates surrounding said quartz glass tube, each of said net plates being connected between two adjacent ones of said connecting rods.

5. The warming oven as claimed in claim 2, wherein said base further includes a plurality of stop plates covering said accommodating space, each of said stop plates being connected between two adjacent ones of said supporting rods.

6. The warming oven as claimed in claim 2, further comprising a roller unit disposed on a periphery of said base and adapted to be contactable with the ground surface by reclining said base.

7. The warming oven as claimed in claim 2, wherein said heating unit includes a fuel source placed on said supporting plate of said base, a heater connected to said fuel source, and a position-limiting member hooked removably on two adjacent ones of said supporting rods for positioning said fuel source within said accommodating space.

8. The warming oven as claimed in claim 2, wherein said outer mirror surface of said reflective shield is vertically curved.

* * * * *